US008826687B2

(12) United States Patent
Bellezza Quater et al.

(10) Patent No.: US 8,826,687 B2
(45) Date of Patent: Sep. 9, 2014

(54) CONTAINER FOR SPECIAL MATERIALS

(75) Inventors: Giorgio Bellezza Quater, San Maurizio Canavese (IT); Paolo Bellezza Quater, San Maurizio Canavese (IT); Silvia Bellezza Quater, San Maurizio Canavese (IT)

(73) Assignee: A.R.I.S. S.p.A., Lombardore, Turin (IT)

( * ) Notice: Subject to any disclaimer, the term of this patent is extended or adjusted under 35 U.S.C. 154(b) by 961 days.

(21) Appl. No.: 12/736,911

(22) PCT Filed: Apr. 22, 2009

(86) PCT No.: PCT/EP2009/002919
§ 371 (c)(1),
(2), (4) Date: Nov. 22, 2010

(87) PCT Pub. No.: WO2009/152889
PCT Pub. Date: Dec. 23, 2009

(65) Prior Publication Data

US 2011/0068107 A1 Mar. 24, 2011

(30) Foreign Application Priority Data

May 30, 2008 (IT) ..... TO2008A0415

(51) Int. Cl.

| | |
|---|---|
| ***F25D 3/08*** | (2006.01) |
| ***F25D 17/06*** | (2006.01) |
| ***F25D 17/04*** | (2006.01) |
| ***F25D 1/00*** | (2006.01) |
| ***F25D 3/06*** | (2006.01) |

(52) U.S. Cl.
CPC ..... *F25D 17/06* (2013.01); *F25D 17/045* (2013.01); *F25D 1/00* (2013.01); *F25D 2303/085* (2013.01); *F25D 3/06* (2013.01)
USPC ..... 62/372; 62/457.2; 62/437

(58) Field of Classification Search
CPC ..... F25D 3/00; F25D 3/125; Y02E 60/147; Y02E 60/145; B60H 1/00492; B60H 1/005; F24F 5/0017
USPC ..... 62/372, 457.2, 437
See application file for complete search history.

(56) References Cited

U.S. PATENT DOCUMENTS

| | | | | |
|---|---|---|---|---|
| 1,984,261 | A * | 12/1934 | Foy | 220/592.26 |
| 4,104,185 | A * | 8/1978 | Schroder | 252/70 |
| 4,750,197 | A * | 6/1988 | Denekamp et al. | 455/404.2 |
| 4,969,509 | A | 11/1990 | Merensky | |
| 6,227,285 | B1 * | 5/2001 | Hildebrand et al. | 165/10 |
| 2007/0034110 | A1 * | 2/2007 | Zupancich et al. | 105/355 |

FOREIGN PATENT DOCUMENTS

| | | | | |
|---|---|---|---|---|
| FR | 869 526 | A | 2/1942 | |
| JP | 58-204059 | * | 11/1983 | C09D 5/00 |

* cited by examiner

*Primary Examiner* — Cassey D Bauer
(74) *Attorney, Agent, or Firm* — Modiano & Associati; Daniel J. O'Byrne

(57) ABSTRACT

A rigid-walled, block-shaped box is internally provided with a compartment arranged adjacent to a vertical wall of the box and having a first chamber with a first window open to the inside of the container and a second window open to the outside, and a second chamber with a third window open to the inside of the container and a fourth window open to the outside. The windows are each provided with a shutter. A mass of phase change material is housed within the compartment between said first chamber and second chamber, for absorbing heat from the air flowing from one chamber to the other chamber when said first window and third window are open and said second window and fourth window are closed, and releasing heat to the air flowing from one chamber to the other chamber when said first window and third window are closed and said second window and fourth window are open.

10 Claims, 3 Drawing Sheets

CONTAINER FOR SPECIAL MATERIALS

The present invention relates to a container for special materials, which is particularly suitable for stocking materials which may flare up or deteriorate under high temperatures in geographic areas marked by particularly hot climates.

BACKGROUND OF THE INVENTION

As known, bulky, block-shaped containers made of metal are used in humanitarian missions or missions of civil protection for stocking equipment of various types in support of the mission. The containers are usually parked at a certain distance from the base prepared for the mission, in squares or open fields. When the mission takes place in areas marked by particularly hot climates, e.g., in desert areas or tropical areas, the temperature within the container may rise up to 70-80° C. This circumstance may cause any perishable material stocked within the container to damage, such as food, medicines, machines requiring a suitable ventilation (e.g., power units), etc., and may also be very dangerous when inflammable/explosive materials are stocked within the container, such as fuels (e.g., for supplying the above-cited power units), munitions, and the like.

Although it is theoretically possible to cool the containers by conventional conditioning plants, this solution is not taken into consideration because the containers are often abandoned, even for very long periods, in non-equipped areas where they are exposed to the inclemency of the weather and to extreme climatic conditions, while the above conditioning plants require constant check and regular maintenance, so that they have not the required operative autonomy.

Therefore, it is a main object of the present invention to provide a container for special materials, which is provided with a both effective and safe cooling system having a high operative autonomy.

SUMMARY OF THE INVENTION

The above object and other advantages, which will better appear from the following description, are achieved by a container having the features recited in claim 1, while the dependent claims state other advantageous, though secondary features of the invention.

BRIEF DESCRIPTION OF THE DRAWINGS

The invention will be now described in more detail with reference to a preferred, non-exclusive embodiment shown by way of non-limiting example in the attached drawings, wherein.

DESCRIPTION OF THE PREFERRED EMBODIMENTS

Figure 6:
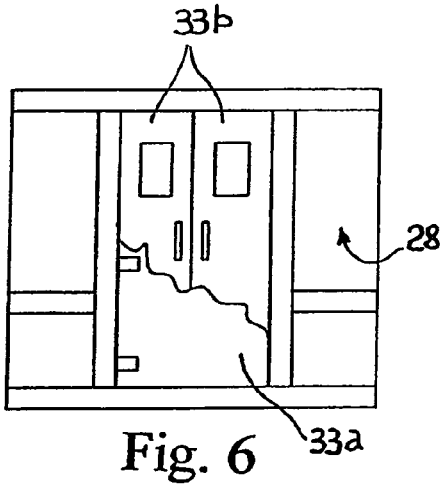
FIG. 6 is a rear view of the container according to the invention.

A block-shaped container 10 is shown in the Figures, which has a trestle-type frame comprising longitudinal members such as 12, cross members such as 14, uprights such as 16, and oblique stiffening beams such as 18, 20 on both its sides. Panels are internally anchored to the trestle-type frame and are interconnected to form two side walls 22, 24, one of which, 24, is provided with a door 25, a front wall 26 and a rear wall 28, a bottom wall 30, as well as a roof 32 for the container. In particular, the panels forming the roof of the container are hinged and attached to the frame by means of a rivet-based connection which is designed to give way when a predetermined pressure threshold is reached due to an explosion in the container, whereby a preferential way out is provided. Rear wall 28 of the container has an opening provided with an outer door 33*a*, which is made of ballistic steel, is mounted on hinges and has functions of insulation, containment of explosions and protection against intrusions, as well as with a couple of inner sliding doors 33*b* which have functions of internal inspection and check without requiring to open the doors (FIG. 6).

Figure 5:
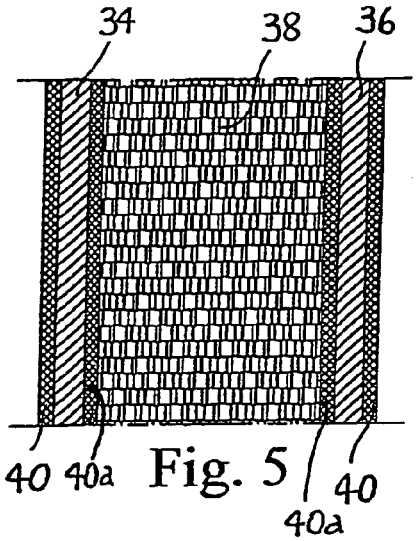
FIG. 5 shows a portion of the wall of the container in cross section.

As shown in detail in FIG. 5, the panels forming the walls of the container have a sandwich structure, with a pair of sheets of ballistic steel 34, 36 having an insulating material 38 sandwiched therebetween, such as high density polyurethane sheets. The outer surfaces the steel sheets 34, 36 forming the panels are coated with a film of cork-containing paint 40, which material, as known, has a relatively low thermal conductivity, while the inner surfaces are lined with cork sheets 40*a*. Therefore, the panels form a protective shell for the container, with both a high mechanical strength and a high degree of thermal insulation.

The container houses a cooling device comprising a block-shaped compartment 42 made of sheet steel, which is anchored adjacent to a side wall of the container and to the bottom, with a vertical, front wall 44 facing the inside of the container, two closed side walls such as 50, and a closed upper face 56. A lower window 58 and an upper window 60 closed by respective, openable shutters 58*a*, 60*a* are formed on front wall 44 near its opposite vertical ends. A lower window 62 and an upper window 64 closed by respective openable shutters 62*a*, 64*a* and open to the inside of compartment 42 are formed on that side wall 24 of the container to which the cooling device is anchored, substantially at the same level of the lower window and the upper window on vertical front wall 44 respectively. The shutters of both inner windows 58, 60 and outer windows 62, 64 are electrically driven to automatically open/close by a programmable control unit C arranged on front wall 44 of the compartment (FIG. 1).

A mass 66 of Phase Change Material (PCM), such as a salt-based material, is supported within compartment 42. Mass 66 is preferably stored in rigid containers which are arranged side-by-side in order to be licked by the air flowing through the compartment with heat exchange, as will be described in more detail below. The mass is arranged between the upper windows and the lower windows, thereby dividing compartment 42 into a lower chamber 68 served by the lower windows, and an upper chamber 70 served by the upper windows. The two chambers are in communication with each other via the gap defined between the inner wall of compartment 42 and mass 66. Fans such as 72 are arranged in compartment 42 to force the air circulation through the compartment and, consequently, the heat exchange from lower chamber 68 to upper chamber 70.

Figure 1:
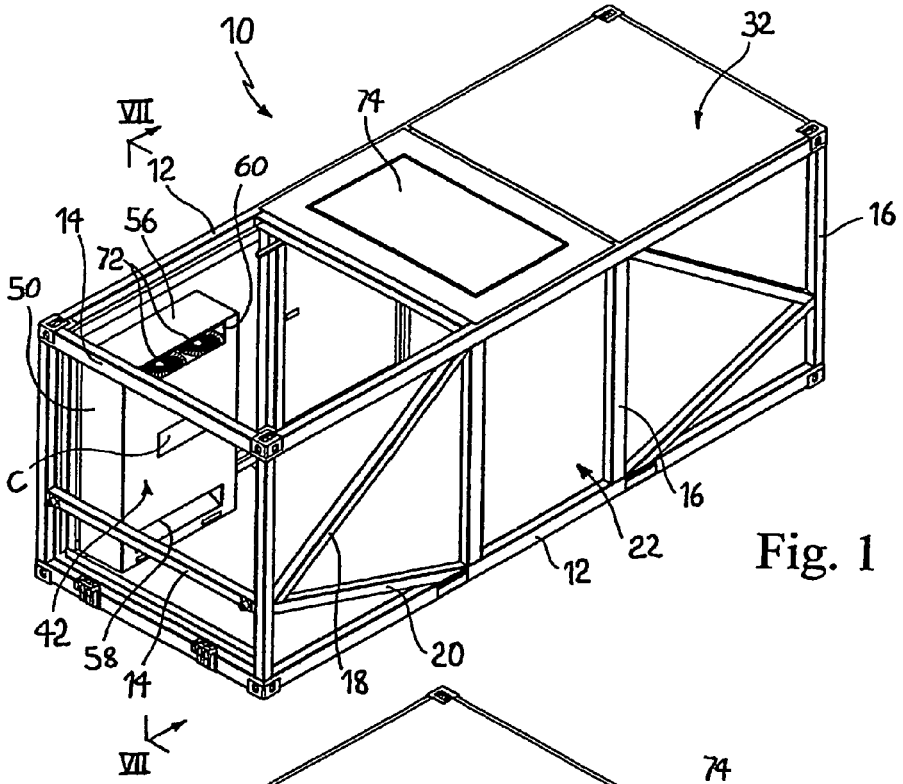
FIG. 1 is a broken-away, perspective view of the container according to the invention, in a first operative configuration.
Figure 2:
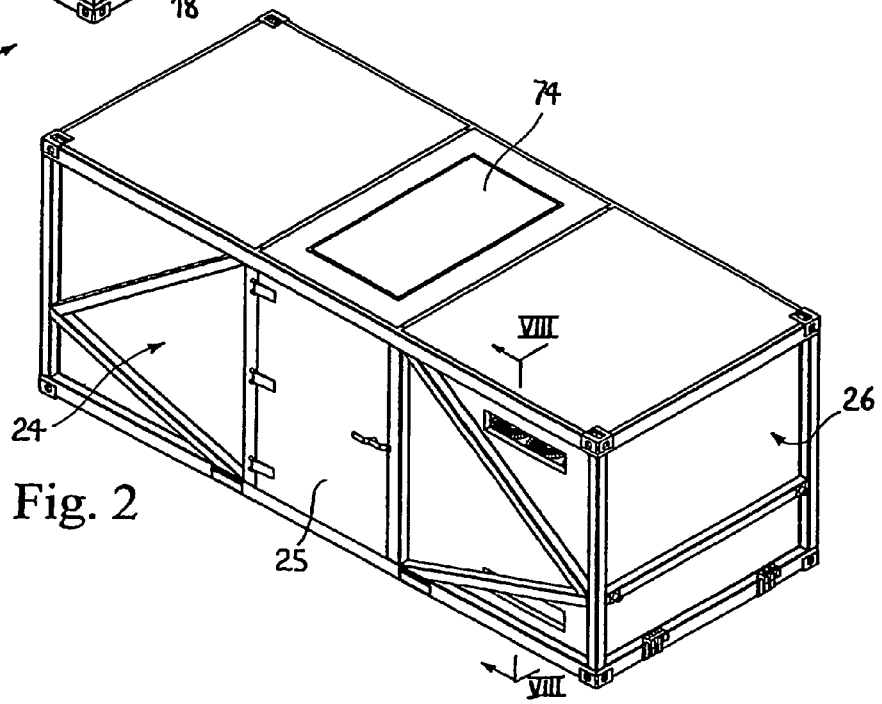
FIG. 2 is a perspective view from a different point of view of the container of FIG. 1, in a second operative configuration.
Figure 3:
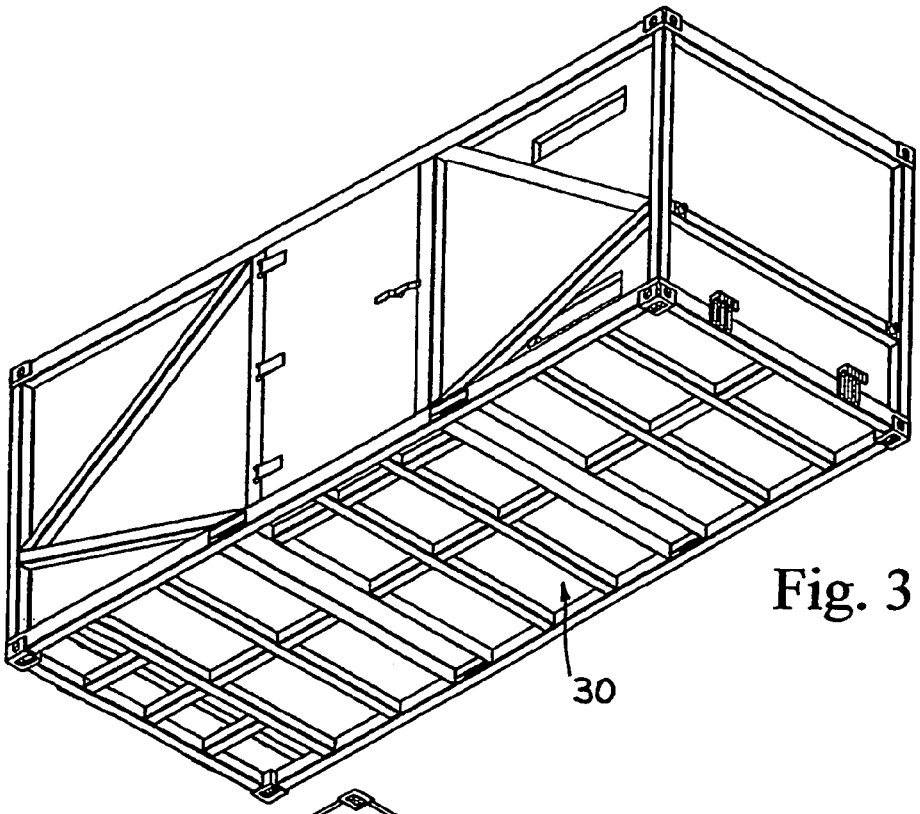
FIG. 3 is a perspective view from another different point of view of the container according to the invention.
Figure 4:
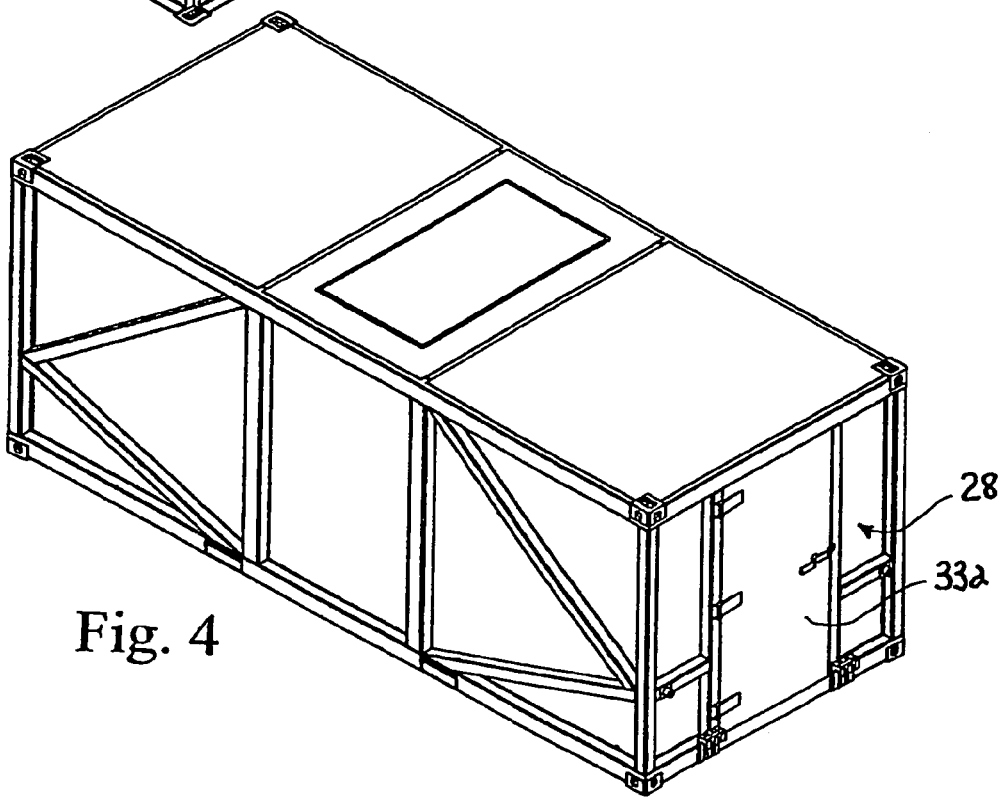
FIG. 4 is a perspective view from a further different point of view of the container according to the invention.

The electrical devices, such as control unit C and fan 72, are supplied by a solar panel 74 installed on roof 32 of the container (FIGS. 1, 2, 4).

Figure 7:
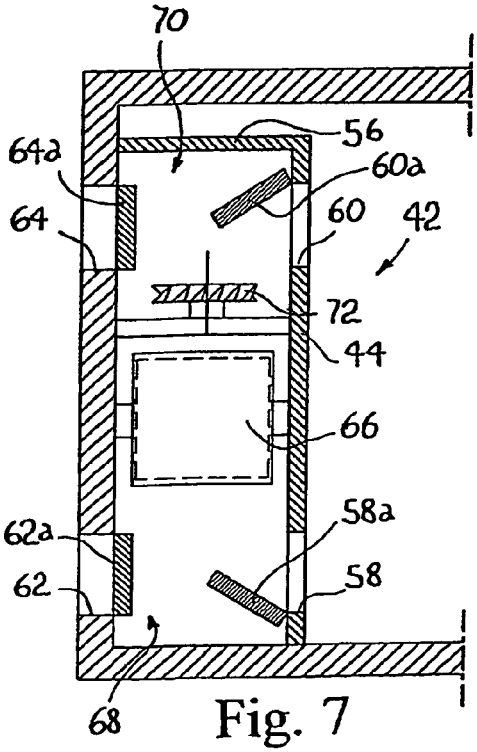
FIG. 7 is a partial cross section view of FIG. 1 along plane VII-VII.

In the day operation, as shown in FIGS. 1, 7, fan 72 is enabled, windows 58, 60 facing the inside of the container are open, and windows 62, 64 on the side wall of the container and open outwards are closed. Accordingly, in this configuration, the environment within the container is thermally insulated from the outside due to the insulating properties of both the cork-containing paint applied to the steel sheets forming the walls of the container and of the insulating material sandwiched between the sheets. Fans 72 force the air within the container to flow through the compartment. In particular, the air is drawn through lower window 58 of the compartment by fans 72, than licks mass 66, and finally is blown through upper window 60. As known, the PCM materials have a high melting temperature so that they can absorb or release a high amount of energy when they melt or solidify at a predetermined temperature. Mass PCM 66 is heated by the air passing through compartment 42, so that it changes its state from solid to liquid. Therefore, the air drawn from lower window 58 is delivered through upper window 60 at a lower temperature, whereby the desired cooling effect is obtained within the container.

Figure 8:
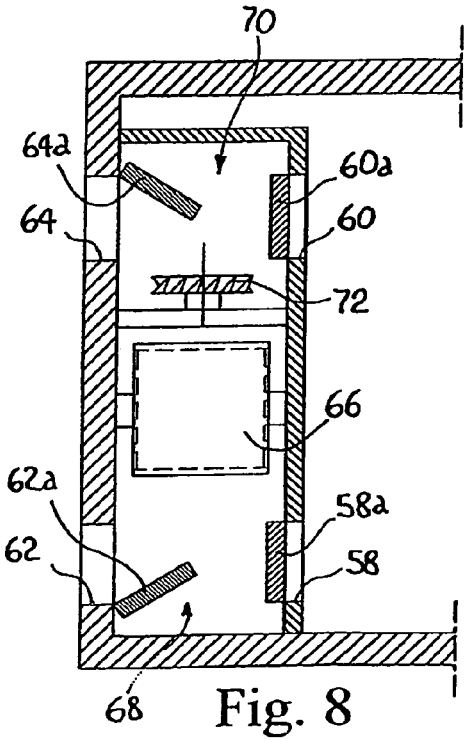
FIG. 8 is partial cross section view of FIG. 2 along plane VIII-VIII.

In the night operation, as shown in FIGS. 2, 8, fans 72 are still enabled, windows 58, 60 facing the inside of the container are closed, while windows 62, 64 formed on the side wall of the container and facing outwards are open. Therefore, also in this configuration the environment within the container is thermally insulated from the outside, but fans 72 force the cool air in the environment outside the container to flow through the compartment. In particular, fans 72 draw cool air through lower window 62 of the container and deliver it through upper window 64. PCM material 66 heated by the air passing through gap G changes its state from liquid to solid, thereby preparing for the new cooling cycle of the next day.

The above operative steps repeat cyclically, whereby a cooling system having a high autonomy is provided. Furthermore, as a person skilled in the art will immediately understand, the structure of the container according to the invention optimizes both the structural strength and the insulating properties of the container, because the supporting function is performed by the frame while the functions of mechanical protection and insulation is performed by the panels anchored to the inside of the frame.

A preferred embodiment of the invention has been described herein, but of course many changes may be made by a person skilled in the art within the scope of the claims. In particular, PCM materials different from those indicated by way of example in the above-described, preferred embodiment, may be used, e.g., paraffin-based materials. Furthermore, the electrical devices, such as the fans and the control unit, can be supplied by means different from those described, e.g., rechargeable batteries may be used in lieu of, or in addition to, the solar panels; the container could also be connected to a power supply, if present. Nevertheless, the air could also flow in the compartment in the opposite direction, i.e., from the top to the bottom, by reversing the operation of the fans. Furthermore, although the fans are useful to enhance the circulation of the air within the compartment, as the person skilled in the art will immediately understand, the air would circulate by "chimney-like" effect even without the fans. Therefore, the fans should be intended as useful but unessential to achieve the invention. The shape and the arrangement of the cooling device within the container could also be different from what shown, and, depending on the circumstances, the container could also be provided with a higher number of cooling devices. Moreover, depending on the circumstances, the cork-containing paint and the cork sheets applied to the panels forming the walls of the container could be unessential, or only one of the faces of the panels could be coated.

The invention claimed is:

1. A container comprising a rigid-walled, block-shaped box, wherein it is provided with an internal compartment adjacent to a vertical wall of the box, in which a first chamber having a first window open to the inside of the container and a second window open to the outside, and a second chamber having a third window open to the inside of the container and a fourth window open to the outside, are defined, each of said windows being provided with a shutter, a mass of phase change material is arranged within the internal compartment between said first chamber and second chamber, for absorbing heat from the air flowing from one chamber to the other chamber when said first window and third window are open and said second window and fourth window are closed, and releasing heat to the air flowing from one chamber to the other chamber when said first window and third window are closed and said second window and fourth window are open, wherein the container is supplied by at least one solar panel mounted on its roof, and wherein the panels forming the roof of the container are connected by means of a rivet-based connection which is designed to give way when a predetermined pressure threshold is reached due to an explosion occurring in the container.

2. The container of claim 1, wherein ventilation means are arranged within said internal compartment, which are operable to force the air from one chamber to the other chamber of the compartment.

3. The container of claim 1, wherein said windows are piloted to open/close by a control unit which is programmed to open said first window and third window and close said second window and fourth window during relatively hot predetermined hours, and to close said first window and third window and open said second window and fourth window during relatively cold predetermined hours.

4. The container of claim 1, wherein said phase change material is a salt-based material.

5. The container of claim 1, wherein said phase change material is a paraffin-based material.

6. The container of claim 1, comprising a trestle-type frame covered with panels each having a sandwich structure, with a couple of steel sheets having an insulating material sandwiched therebetween.

7. The container of claim 6, wherein said panels are internally anchored to the trestle-type frame.

8. The container of claim 6, wherein at least one of the faces of said steel sheets forming the panels is coated with a film of cork-containing paint.

9. The container of claim 6, wherein at least one of the faces of said steel sheets forming the panels is lined with a cork sheet.

10. The container of claim 1, wherein it has an opening provided with an outer door made of ballistic steel and mounted on hinges, and with a couple of inner sliding doors.

* * * * *